US005870774A

United States Patent [19]

Legenstein

[11] Patent Number: 5,870,774

[45] Date of Patent: Feb. 16, 1999

[54] ROLLING KNEE PAD

[76] Inventor: Mark P. Legenstein, 1855 Columbia Ave., Lancaster, Pa. 17603

[21] Appl. No.: 920,637

[22] Filed: Aug. 29, 1997

[51] Int. Cl.[6] ..... A41D 13/06

[52] U.S. Cl. ..... 2/24; 280/32.5

[58] Field of Search ..... 2/24, 23, 911, 2/16, 20, 267, 62, 22; 280/32.6

[56] References Cited

U.S. PATENT DOCUMENTS

| | | | |
|---|---|---|---|
| D. 353,702 | 12/1994 | Martinez et al. | D34/23 |
| 1,533,907 | 4/1925 | Whipp . | |
| 1,547,166 | 7/1925 | Davidson . | |
| 5,380,021 | 1/1995 | Doherty | 280/32.6 |
| 5,537,689 | 7/1996 | Dancyger | 2/24 |

*Primary Examiner*—Michael A. Neas
*Assistant Examiner*—Larry D. Worell, Jr.
*Attorney, Agent, or Firm*—Dan Williams

[57] ABSTRACT

A roller knee pad having a hard shell supported by a plurality of swiveling casters. The inside of the hard shell is lined with a cushioning material to absorb shock when kneeling and to cushion against minor shape disparities between the wearers knees and the inside of the hard shell. A plate is attached to the exterior portion of the hard shell to provide mounting locations for a plurality of casters. The casters are capable of swiveling through a 360 degree range. Ideally three casters are used to support the knee pad allowing the pad to be self supporting and allowing the wearer to easily balance on the knee pad without exerting undue pressure on his/her toes. A rolling knee pad is strapped to each of the wearers knees allowing the user to kneel without concern about placement of the knee pad. Once the knee pads are engaged to the floor surface, the wearer may move laterally in any direction while still on his/her knees. If desired, the user may rise, walk to another location and then re-kneel without having to engage one hand with carrying the knee pads. Both hands are thus free to carry tools and materials when rising and kneeling on the invention.

18 Claims, 2 Drawing Sheets

ROLLING KNEE PAD

BACKGROUND

1. Field of the Invention

The present inventions relate to devices used to protect the knees of persons who spend time on their knees. More particularly, the present invention relates to rolling knee pads that not only protect and cushion the knee but also provide mobility to the wearer while still on his/her knees.

2. Description of the Related Art

Simple knee pads are designed to cushion and protect the wearers knee when the wearer knees contact the ground plane. Some types of knee pads comprise a wear resistant surface layer that contacts the ground plane and a cushioned inside layer that contacts, directly or indirectly, the wearers knee. Other types of knee pads merely comprise a cushion layer to cushion the knee against a hard surface.

Still other types of knee pads have a mechanism to facilitate rolling the knee pad along a surface. These rolling knee pads or cushions may be designed to protect the knee while also providing the wearer with a degree of mobility while the wearer is in the kneeling position. In this type of knee pad, comfort and easy mobility are important to the wearer. It is desirable that the rolling knee pad be easily moveable and that the wearer be able to rise and kneel back upon the knee pad without having to orient the knee pad with his hands because the wearers hands are often engaged, either in grasping tools or materials, or at some other endeavor.

Holsey, U.S. Pat. No. 1,296,522 shows an early design offering a combination rolling feature in a pad that is strapped to the wearers knee. In the Holsey pad, the wearer is supported by one roller and a bar.

Davidson, U.S. Pat. No. 1,547,166 is a more advanced rolling knee pad having two rollers and a support cushion for the knee. The device is again strapped to the wearers knee.

Ashbridge, U.S. Pat. No. 1,382,883 shows a kneeling support that allows the user to kneel on a padded cushion attached to a rolling dolly. The rolling dolly is not attached to the wearers knee.

Martinez et al., U.S. Pat. No. Des. 353,702 shows another rolling knee support. This design has two support pads joined by two rods. Each pad is supported by four wheels. There are no provisions for attaching this roller knee pad to the users knees.

The above devices work well for many applications. However, no device allows the wearer full freedom to rise and resume kneeling without having to position the pad when kneeling and still have full kneeling mobility in any lateral direction. Holsey and Davidson allow the wearer to rise and resume kneeling without having to position the knee pad when kneeling but they only allow kneeling mobility in one direction, ie. perpendicular to the roller axis.

Ashbridge and Martinez et al. allow kneeling mobility in two directions but do not allow the user to rise and then kneel without having to worry about placement of his/her knees on the device.

What is needed is a device which allows the user to rise and resume kneeling without having to pay attention to the placement of the rolling knee pad. At the same time, many users would like the rolling knee pads to easily move laterally in any direction. This combination of features would be valuable for persons who demand extensive lateral movement in any direction when on their knees and who must often rise and re-kneel when moving quickly across large spaces or to retrieve tools and materials.

SUMMARY OF THE INVENTION

One object of the present invention is to provide means to cushion and protect a users knees as he/her assumes and maintains a kneeling position.

Another object of the present invention is to provide mobility to the user when he/her is in the kneeling position. Such mobility should be such that the user is able to move laterally in any direction without having to rise to his/her feet.

Yet another object of the present invention is to allow the user to initially kneel and then rise and re-kneel without having to be concerned about the placement of the rolling knee pad. The user should be able to kneel without a concern about whether the rolling knee pads are in the proper position to contact his/her knees.

Still another object of the present invention is to provide means for the user to rise, move a long distance, and then be able to re-kneel without concern about moving the rolling knee pads. Moving rolling knee pads can engage one hand that could otherwise be free for carrying tools or other items.

Some of these objects are provided by equipping rigid cushioned individual knee pads with fastening straps that attach the individual knee pad to the correct position on the respective knee. The remaining objects are provided by equipping each knee pad with its own roller suspension system that allows the pad to move laterally in any direction on the roller suspension system. The system must be stable so that the knee pad is not prone to rocking.

These provisions allow the pad to be firmly attached to the wearers knee thus allowing the wearer to rise, move and re-kneel without undue concern about whether his/her knee will be correctly placed on the knee pad. The user is also able to easily move laterally in any direction.

The rolling knee pad comprises a soft inner cushion designed to contact the wearers knee. The cushion protects the knee and absorbs shock when the wearer kneels. Outside the soft inner cushion is a hard shell area designed to provide rigid support for the cushion. The hard shell also provides a rigid area to which the roller support system can be mounted. Attached to the shell, cushion, cushion/shell interface, or even the roller support are means to attach and detach the knee pad to the wearers knees. These means must be convenient, easy to use and yet provide continuous positive engagement of the pad to the knee area. Such engagement can be obtained by a suitable strap/buckle, strap/velcro, elastic sleeve, or other arrangement.

The roller support is positioned on one side of hard shell; the side opposite the cushion. The side opposite the cushion is normally the convex surface of the hard shell. The roller support may be shaped to approximate the contour of the hard shall. Attached around the periphery of the roller support are a plurality of rollers. Three rollers are most desireable because this gives maximum stability to the roller arrangement while minimizing cost. The rollers can be any type that swivels, however, limitations in travel direction are encountered by rollers or casters that swivel less than 360 degrees and a full swiveling roller is most desired. All rollers are positioned to contact a single plane surface. In this way the rollers can run smoothly in any direction across a plane surface. The material used to construct the rollers should be one that would not mar or mark the surface on which the rollers roll.

BRIEF DESCRIPTION OF THE DRAWINGS

These and other features, aspects, and advantages of the present invention will become better understood with regard to the following description and accompanying drawings where.

DESCRIPTION

Although the disclosure herein is detailed and exact to enable those skilled in the art to practice the invention, the physical embodiments herein disclosed merely exemplify the inventions which may be embodied in other specific structures.

The rolling knee pad consists essentially of a cushioned knee pad having a hard outer shell being mounted on a platform having a plurality of rotating wheels. The platform is supported by a plurality of casters. The roller casters roll about a central axis, as does a wheel rotate about its hub, and also swivel about an axis perpendicular to the hub axis and plane which contacts the wheels.

Figure 1:
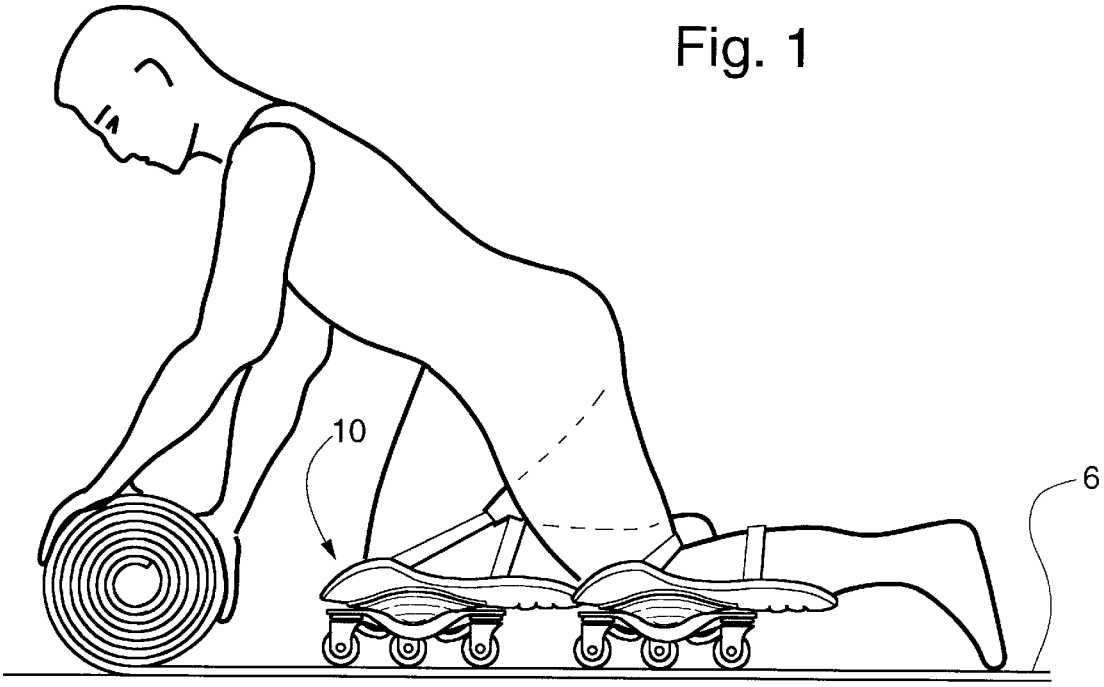
FIG. 1 is schematic illustration of my rolling knee pads as worn.

Operation of the rolling knee pad is readily seen in FIG. 1 which depicts a pair of rolling knee pads 10 worn by a person engaged in unrolling flooring material. Construction of the rolling knee pad is better seen in FIG. 2, which represents a bottom plan view of my invention, and FIG. 3 which is a cross sectional view of my rolling knee pad taken across the plane 3—3 of FIG. 2.

The knee pad portion of rolling knee pad 10 comprises essentially of hard shell 20 and cushion 22. Straps 24, 24*a* are utilized to fasten the knee pad to the knee by surrounding the knee area with strap 24 and complementary strap 24*a* and pressing hook fasteners 26 against loop fasteners 28. This fastening arrangement is sold under the Velcro® trademark of Velcro Industries, B.V. Velcro® is easily fastened and unfastened and is the preferred fastener. Of course other types of fasteners could be used to attach straps 24,24*a* to one another. Buckle fasteners of various types are inexpensive and readily available although some types may be somewhat more difficult or cumbersome in operation. A new style buckle is now available in which a male portion is introduced into a female portion until the buckle snaps together. These buckles are usually released by merely pinching the male portion. A limitation of some types of buckles is that the length of the straps must be independently adjusted. Some buckles permit strap length adjustment as part of the buckle design but other types of buckles must have independent adjustment means added to the strap. Of course the strap may also be partially or wholly fabricated of an elastic material to minimize any problems with adjusting the length of the straps. A sleeve attachment to the knee area could also be used. In this type of attachment, an elastic sleeve would be attached to the cushion and the entire leg would be inserted through the sleeve until the knee is proximate to the knee pad. Other attachment methods may also prove satisfactory.

Figure 2:
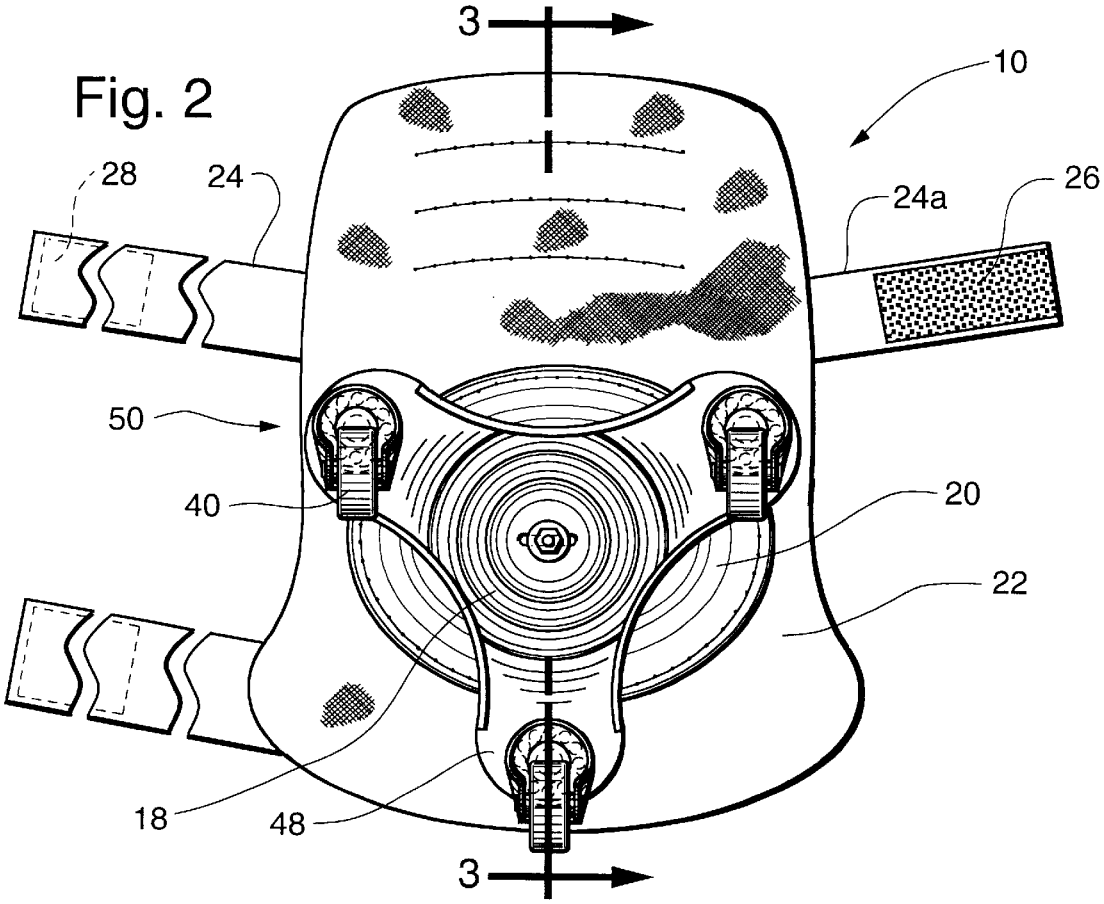
FIG. 2 is a bottom plan view of my rolling knee pad.

Hard shell 20 is depicted in FIG. 2 as being relatively small and covering only the knee cap portion of the knee area. In contrast, cushion 22 is depicted as extending down the leg to the shin area. Shell 20 need only be large enough to support roller support plate 18 so plate 18 does not protrude through cushion 22 to contact the wearers knee. It can be seen that shell 20 has a concave side facing toward the wearers knee on which cushion 22 is mounted. Shell 20 is made of thin hard material sufficiently rigid to support the knee without deformation. Shell 20 should be made of a material with sufficient impact resistance so as to not break when the user kneels and puts his/her entire weight suddenly on shell 20. Although a plastic shell is contemplated, a metallic material of suitable thickness and strength would also be suitable.

Cushion 22 extends over shell 20 and cushions the wearers knee area. Cushion 22 may extend down to the shin area and far enough forward that plate 18 does not contact the wearers leg. Cushion 22 would desirably be fabricated of foam and covered with fabric. As an alternative to foam, many plastics may be fabricated with a durometer hardness that would be useful as a cushion. Other older style cushion materials such as matted hair may also be used.

Roller support plate 18 is a mounting plate on which roller assemblies 50 are mounted. Plate 18 is preferably fabricated in a contour that matches the contour of shell 20. The contour serves to reduce the overall height of the knee pad. At its periphery, the contour of plate 18 is disposed laterally until it would roughly parallel the floor plane when the roller knee pad is supported by the floor as shown in FIG. 1. At its' periphery, plate 18 is attached to or becomes roller mounting area 48. It is contemplated that plate 18 be fabricated as a single piece with area 48 shaped to a suitable angle. Area 48 serves as an attachment location for roller assemblies 50.

Figure 3:
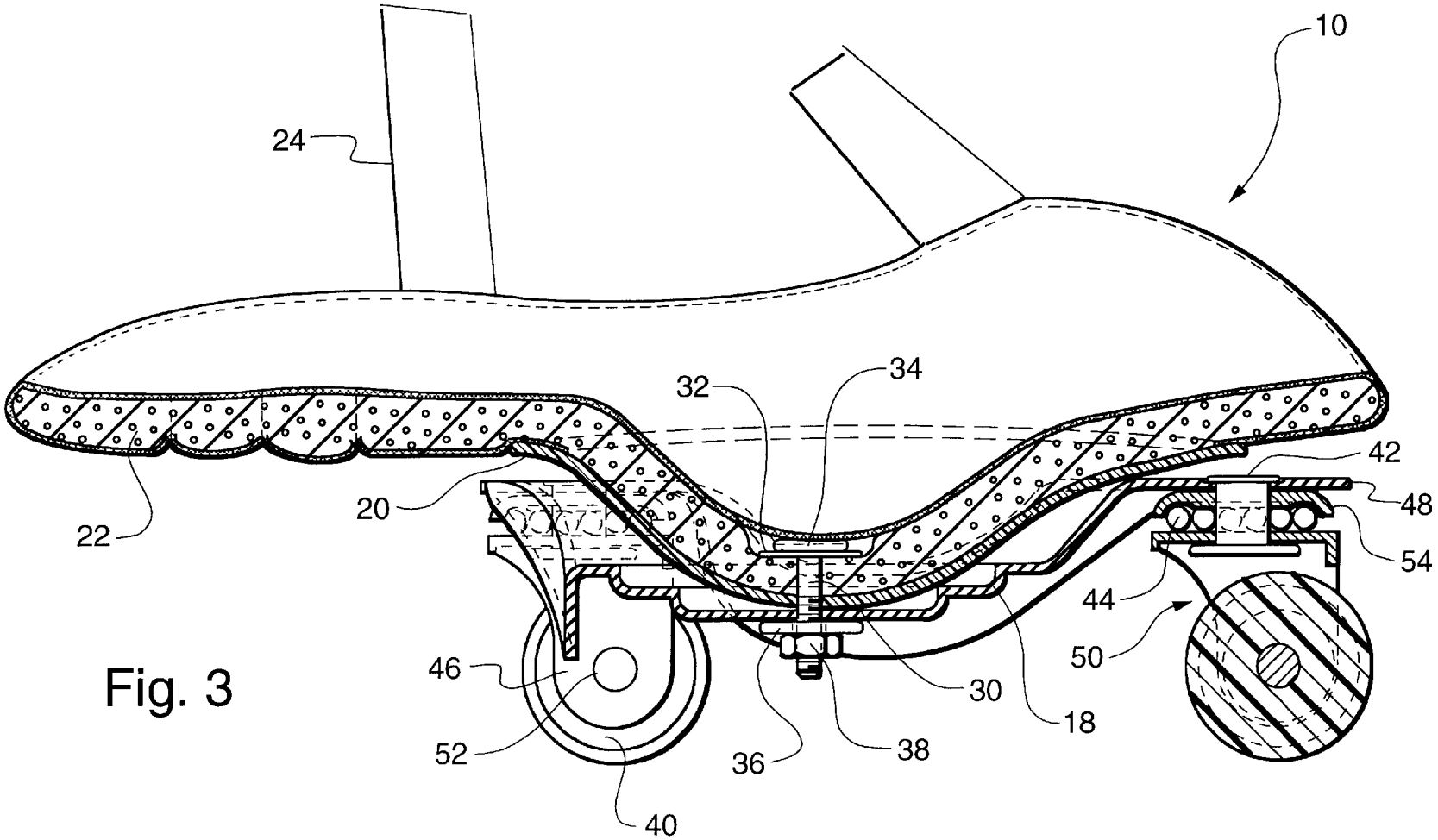
FIG. 3 is a sectional view of my rolling knee pad taken on the line 3—3 of FIG. 2, taken with the knee pad in right-side-up working orientation.

Plate 18 is attached to hard shell 20 by passing mounting bolt 30 through an orifice in shell 20 as shown in FIG. 3. Bolt 30 is fastened with nut washer 36 and nut 38. Washer 32 may be used to extend the area of bolt head 34 if necessary. Bolt head 34 must necessarily be of low profile such that head 34 does not extend above cushion 22 when the wearers weight is upon the knee pad. Other means of fixed or removeable attachment may also prove suitable. If shell 20 and plate 18 have close enough contours it may prove possible to attach shell 20 to plate 18 by adhesive means. It may also be possible to combine plate 18 and shell 20 into one preformed unit having mounting stubs on which roller assemblies 50 may be mounted.

In the preferred embodiment three roller assemblies 50 are mounted on plate 18. Three roller assemblies provide a stable platform on which the wearer may easily move about. Two roller assemblies would be unstable and require the wearer to balance on his knees and toes. Four roller assemblies may be attached to plate 18, however, the addition of the fourth and subsequent roller assemblies gains little in stability and each roller assembly adds cost to the structure.

It is also contemplated that roller assemblies 50 be fastened directly to shell 20. To accomplish this design, shell 20 would need to be modified from that as shown to provide attachment points for the requisite number of roller assemblies.

Roller assembly 50 is comprised of roller 40 mounted on an axle 52. Axle 52 is mounted in roller housing 46 leaving roller 40 free to spin as necessary. Housing 46 is rotationally mounted to area 48 on support pin 42. Ball bearings 44 positioned in bearing race 54 allow roller assembly 50 to freely swivel around support pin 42. As seen in FIG. 3, the wheels are mounted so that a plane parallel to the floor and intersecting the uppermost portion of the wheels is above a horizontal plane intersecting the lowermost portion of the central concave portion of the rigid shell. Although the structure shown and described is preferred and is generally known as a caster, other roller assemblies having different structure may be substituted, however, assembly 50 must be free to rotate so the wearer may move in any direction. If roller assembly is not free to rotate about a vertical axis (as referenced from horizontal floor 6 in FIG. 1), the wearer would not be able to move in any direction. Although not contemplated, for some applications it may be desirable that assembly 50 not rotate or that rotation would be limited. This would limit the wearers freedom of movement.

The rollers should be made of a material that will not mar or mark the horizontal surface on which the rollers move. Rubber has been found to be desirable, however, plastics of suitable hardness and colors may also be utilized. Metal rollers may also be used to advantage.

The foregoing invention has significant advantages over prior rolling knee pads. The rolling knee pads of the present invention allow mobility in any lateral direction while at the same time being fixed to the wearers knee thus allowing the wearer to rise and kneel at will. Moreover, the wearer can kneel when both hands are occupied without having to worry about whether the pads are in the correct position or orientation to receive his/her knees. No prior knee pad demonstrates this combination of desirable features.

Many modifications and variations of the above invention is possible. It is therefore understood that the invention may be practiced otherwise than as specifically before described and still fall within the scope of the claims.

What is claimed is:

1. A rolling knee pad comprising:

(a) a hard thin rigid shell having a concave inner surface and a convex outer surface;

(b) a cushion fixedly attached to said inner surface;

(c) a mounting plate, outwardly disposed from said outer surface, said mounting plate being concave to accommodate said convex outer surface, and fixedly attached to said shell;

(d) a plurality of roller mounting areas disposed at the periphery of said mounting plate and fixedly attached to said plate;

(e) a plurality of casters, each caster being rotateably mounted to one of said mounting areas and being free to swivel about an axis vertically perpendicular to said floor;

(f) means to attach and detach said knee pad from said knee.

2. The rolling knee pad of claim 1 wherein the means of attachment and detachment comprises straps permanently attached to said knee pads, the straps having complementary hook and loop fasteners.

3. The rolling knee pad of claim 1 wherein the roller mounting areas are three in number and disposed in a triangular pattern around the periphery of said mounting plate.

4. The rolling knee pad of claim 1 wherein said mounting plate and said hard shell are of unitary construction.

5. The rolling knee pad of claim 4 wherein the roller mounting areas are three in number and disposed in a triangular pattern around the periphery of said mounting plate.

6. The rolling knee pad of claim 4 wherein the means of attachment and detachment comprises straps permanently attached to said knee pads, the straps having complementary hook and loop fasteners.

7. The rolling knee pad of claim 1 wherein said mounting plate is molded to conform to the shape of said outer surface of said hard shell and fixedly attached to said hard shell.

8. A rolling knee pad to support a kneeling person when on his/her knees on a horizontal surface comprising:

(a) a hard rigid shell having an inner surface, an outer surface and a plurality of roller mounting areas, said inner surface having a central concave portion recessed to accommodate a knee, said roller mounting areas being disposed on the outer surface at the periphery of said shell;

(b) a plurality of roller housings, each roller housing rotateably mounted to one of said mounting areas and free to rotate about a first axis, said first axis being perpendicular to said horizontal surface when said rolling knee pad is resting on said horizontal surface;

(c) a plurality of wheels, each wheel rotateably mounted in one of said roller housings and being free to rotate about an axis parallel to a plane described by said roller mounting areas, said wheels being mounted so that when said wheels are resting on a horizontal floor, a plane parallel to the floor and intersecting the uppermost portion of said wheels is above a horizontal plane intersecting the lowermost portion of said central concave portion; and (d) means to attach and detach said knee pad from said knee.

9. The rolling knee pad of claim 8 further comprising a cushion fixedly attached to said inner surface.

10. The rolling knee pad of claim 9 wherein the means to attach and detach said knee pad from said knee comprises straps permanently attached to said knee pads, the straps having complementary hook and loop fasteners.

11. The rolling knee pad of claim 8 wherein the roller mounting areas are three in number and disposed in a triangular pattern around the periphery of said shell.

12. The rolling knee pad of claim 9 wherein the means to attach and detach said knee pad from said knee comprises a first strap and a second strap, both straps having a first end permanently attached to said knee pads and a second end, a buckle attached to the second end of the first strap, and means to removably attach the second end of said second strap to said buckle.

13. The rolling knee pad of claim 12 having adjustment means to vary the length of said straps so that said straps may be adjusted for the circumference of said users knees.

14. A rolling knee pad for supporting a knee comprising:

(a) a hard rigid support having a first concave surface and a second surface, said second surface having a plurality of mounting areas disposed beneath said second surface;

(b) a cushion fixedly attached to said first concave surface;

(c) a plurality of wheel mounting housings rotateably attached to said mounting areas, each mounting housing being equipped with an axle;

(d) a plurality of wheels rotateably mounted on said axles so that when said wheels are resting on a horizontal surface, a horizontal plane intersecting the uppermost periphery of said wheels is above said first concave surface;

(e) means for removably attaching said knee pads to said knee.

15. The rolling knee pad of claim 14 wherein at least two of said wheel mounting housings are intersected by a vertical line between said second surface and said horizontal surface.

16. The rolling knee pad of claim 15 wherein the means of removeably attaching said knee pads comprises straps permanently attached to said knee pads, the straps having complementary hook and loop fasteners.

17. The rolling knee pad of claim 1 wherein said casters swivel beneath said shell.

18. The rolling knee pad of claim 8 wherein said wheels pass beneath said hard rigid shell when rotated about said first axis.

* * * * *